US010006659B2

(12) United States Patent
Ojiro

(10) Patent No.: US 10,006,659 B2
(45) Date of Patent: Jun. 26, 2018

(54) HEAT SOURCE APPARATUS

(71) Applicant: RINNAI CORPORATION, Nagoya-shi, Aichi (JP)

(72) Inventor: Takashi Ojiro, Nagoya (JP)

(73) Assignee: RINNAI CORPORATION, Aichi (JP)

( * ) Notice: Subject to any disclaimer, the term of this patent is extended or adjusted under 35 U.S.C. 154(b) by 0 days. days.

(21) Appl. No.: 15/598,437

(22) Filed: May 18, 2017

(65) Prior Publication Data

US 2017/0350617 A1 Dec. 7, 2017

(30) Foreign Application Priority Data

Jun. 2, 2016 (JP) ..... 2016-110792
Jun. 20, 2016 (JP) ..... 2016-121533

(51) Int. Cl.
*F24H 1/40* (2006.01)
*F24H 1/14* (2006.01)
(Continued)

(52) U.S. Cl.
CPC ..... *F24H 1/145* (2013.01); *F23N 5/12* (2013.01); *F24H 1/06* (2013.01); *F24H 1/30* (2013.01);
(Continued)

(58) Field of Classification Search
CPC .. F24H 1/40; F24H 8/00; F22B 29/061; F22B 15/00; F22B 37/20
See application file for complete search history.

(56) References Cited

U.S. PATENT DOCUMENTS 2,632,435 A * 3/1953 Lundstrum ..... F24C 3/004 126/116 B
6,224,370 B1 * 5/2001 Tomizawa ..... F23C 13/00 165/166

(Continued)

FOREIGN PATENT DOCUMENTS

EP 2811141 A1 12/2014
JP 3-030056 U 3/1991

*Primary Examiner* — Gregory A Wilson
(74) *Attorney, Agent, or Firm* — Cermak Nakajima & McGowan LLP; Tomoko Nakajima

(57) ABSTRACT

In a heat source apparatus in which an electric component having an electrode and an insulator is mounted on a side plate of a combustion box, in a state in which a packing is interposed between a flange portion of the insulator and the side plate, by fastening to the side plate a clamp which overlaps with an outer surface of the flange portion, the packing is prevented from getting spread when compressed, thereby securing good sealing properties.
Upper and lower water tubes constituting a part of a water jacket are disposed on a side plate on upper and lower sides of the mounting position of the electrode component. In case the upper and lower water tubes are disposed on an inside surface of the side plate, upper and lower side edge portions of the packing are in contact with those upper and lower swelled-out portions formed in the one-side side plate which are swollen outward for respectively receiving into recesses the upper and lower water tubes; and that, in case the upper and lower water tubes are disposed on an outside surface of the side plate, upper and lower side edge portions of the packing are in contact with the upper and lower water tubes.

2 Claims, 7 Drawing Sheets

(51) Int. Cl.

| | |
|---|---|
| ***F24H 1/06*** | (2006.01) |
| ***F24H 9/02*** | (2006.01) |
| ***F24H 9/20*** | (2006.01) |
| ***F23N 5/12*** | (2006.01) |
| ***F24H 1/30*** | (2006.01) |
| ***F24H 1/34*** | (2006.01) |
| ***F24H 1/44*** | (2006.01) |
| ***F24H 9/18*** | (2006.01) |

(52) U.S. Cl.

CPC ..... *F24H 1/34* (2013.01); *F24H 1/403* (2013.01); *F24H 1/44* (2013.01); *F24H 9/02* (2013.01); *F24H 9/1809* (2013.01); *F24H 9/2028* (2013.01); *F24H 9/2035* (2013.01); *F23D 2207/00* (2013.01); *F23N 2041/04* (2013.01); *F23N 2900/05005* (2013.01)

(56) References Cited

U.S. PATENT DOCUMENTS

| | | | | |
|---|---|---|---|---|
| 6,237,586 | B1 * | 5/2001 | Fontes | F24H 1/0081 122/13.01 |
| 2015/0369495 | A1 * | 12/2015 | Maricic | F23D 14/045 126/116 A |
| 2016/0377282 | A1 * | 12/2016 | Sugioka | F23D 14/02 431/353 |
| 2018/0087805 | A1 * | 3/2018 | Ooshita | F24H 1/124 |

* cited by examiner

HEAT SOURCE APPARATUS

BACKGROUND OF THE INVENTION

1. Technical Field

The present invention relates to a heat source apparatus which is provided with: a burner; a combustion box for enclosing a combustion space for air-fuel mixture ejected from a combustion surface of the burner; and a heat exchanger, disposed in the combustion box, for heating cold water.

2. Background Art

As this kind of heat source apparatus, there is known one having mounted an electrode component in that portion of a side plate on one side of the combustion box which lies between the burner and the heat exchanger. The electrode component comprises: an electrode which protrudes into the combustion box through a through-hole formed in the one-side side plate; and an insulator through which the electrode is fixedly inserted (see, e.g., patent document, JP-UM-H3-30056). In this specification, the "side plate on one side" is also referred to as "one-side side plate" for brevity. In this arrangement, the insulator has a flange portion which overlaps with a portion of outside surface around the through-hole in the one-side side plate. In a state in which a packing is interposed between the flange portion and the one-side side plate, a clamp (or a retainer) which overlaps with an outside surface of the flange portion is fastened to the one-side side plate, whereby the electrode component is mounted in position on the one-side side plate.

In the above-mentioned prior art example, the reason why the packing is used is to prevent the combustion gas inside the combustion box from leaking to the outside through the through-hole. However, since the packing is conventionally not restrained in the periphery of the packing, when the packing is compressed at the time of fastening the clamp, the packing is likely to be expanded in the peripheral direction. As a result, the compression stress inside the packing cannot be enhanced sufficiently, resulting in poor sealing properties.

Further, as a heat source apparatus, there is known one, in EP-A-2811141, in which a water jacket is disposed in that portion of the combustion box which lies between the burner and the heat exchanger, the water jacket being connected to the heat exchanger in order to cool the combustion box. Part of the water jacket is constituted by water tubes to be disposed on a side plate of the combustion box.

SUMMARY

Problems that the Invention is to Solve

This invention has a problem of providing a heat source apparatus in which the packing is prevented from expanding at the time of compression, the prevention being materialized by taking advantage of the water tubes that are disposed on the side plate of the combustion box so that good sealing properties can be obtained.

Means for Solving the Problems

In order to solve the above problem, this invention has an advantage of providing a heat source apparatus comprising: a burner; a combustion box for enclosing a combustion space for air-fuel mixture ejected from a combustion surface of the burner; a heat exchanger, disposed in the combustion box, for heating cold water; a water jacket disposed in that portion of the combustion box which lies between the burner and the heat exchanger, the water jacket being connected to the heat exchanger in order to cool the combustion box; an electrode component mounted in that portion of a one-side side plate of the combustion box which lies between the burner and the heat exchanger. The electrode component comprises: an electrode which protrudes into the combustion box through a through-hole formed in the one-side side plate; and an insulator through which the electrode is fixedly inserted. The insulator has a flange portion which overlaps with a portion of outside surface around the through-hole in the one-side side plate and, in a state in which a packing is interposed between the flange portion and the one-side side plate, a clamp which overlaps with an outside surface of the flange portion is fastened to the one-side side plate, whereby the electrode component is mounted in position on the one-side side plate. The first invention of this application has the following features. In other words, upper and lower water tubes constituting a part of the water jacket are disposed on the one-side side plate in a state of being positioned on upper and lower sides, respectively, of the position of mounting the electrode component. In case the upper and lower water tubes are disposed on an inside surface of the one-side side plate, upper and lower side edge portions of the packing are in contact with those upper and lower swelled-out portions formed in the one-side side plate which are swollen outward for respectively receiving, into the swelled-out portions, the upper and lower water tubes. In case the upper and lower water tubes are disposed on an outside surface of the one-side side plate, the upper and lower side edge portions of the packing are in contact with the upper and lower water tubes. The second invention of this application has the following features. In other words, upper and lower water tubes constituting a part of the water jacket are disposed on an inside surface of the one-side side plate on upper and lower sides, respectively, of the position of mounting the electrode component. The one-side side plate has swelled-out portions formed to swell outward such that the upper and lower water tubes are together fitted into the swelled-out portions. An upper half of the swelled-out portions is formed to have an inclined portion inclined inward from a most swelled-out upper portion downward. A lower half of the swelled-out portions is formed to have an inclined portion inclined inward from a most swelled-out lower portion upward. The through-hole for inserting the electrode is formed in a position between the inclined portion of the upper half and the inclined portion of the lower half such that an upper portion and a lower portion of the packing are, respectively, in contact with the inclined portions of the upper half and the lower half.

According to the first invention, the upper and lower side edge portions of the packing are in contact with the upper and lower swelled-out portions or the upper and lower water tubes. Therefore, when the packing is compressed by fastening the clamp, the packing can be prevented from expanding in the upward and downward directions. Further, according to the second invention, the upper and lower portions of the packing are in contact with the inclined portions of the upper half and the lower half of the swelled-out portions. Therefore, when the packing is compressed by fastening the clamp, the upward and downward components of the compression reaction forces from the inclined portions operate in the downward direction on the upper portion of the packing, and in the upward direction on the lower portion of the packing, whereby the packing can be prevented from expanding in the upward and downward directions. Therefore, in either of the first and second inventions, the compression stress inside the packing can be sufficiently enhanced, thereby obtaining good sealing properties.

PREFERRED EMBODIMENTS FOR CARRYING OUT THE INVENTION

Figure 1:
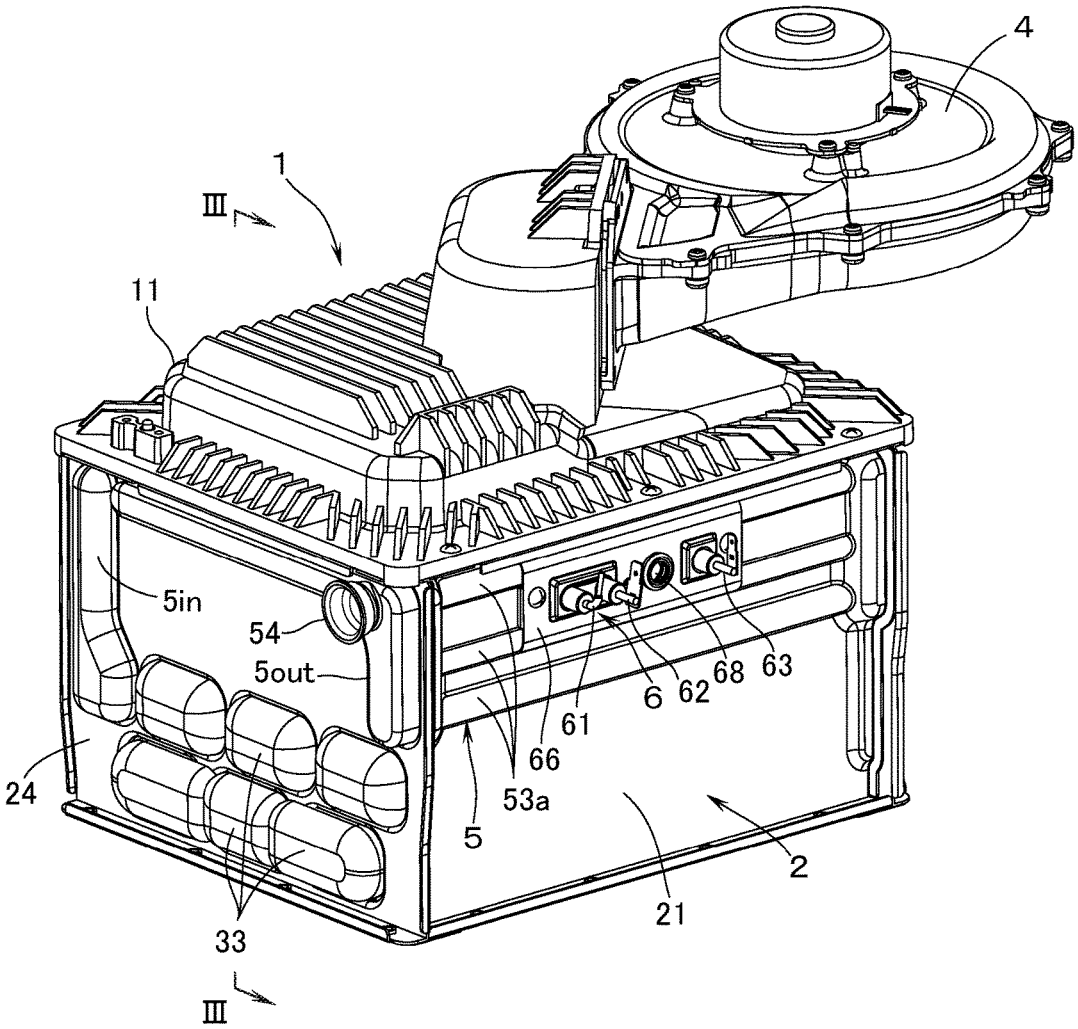
FIG. 1 is a perspective view of a heat source apparatus of a first embodiment of this invention.
Figure 2:
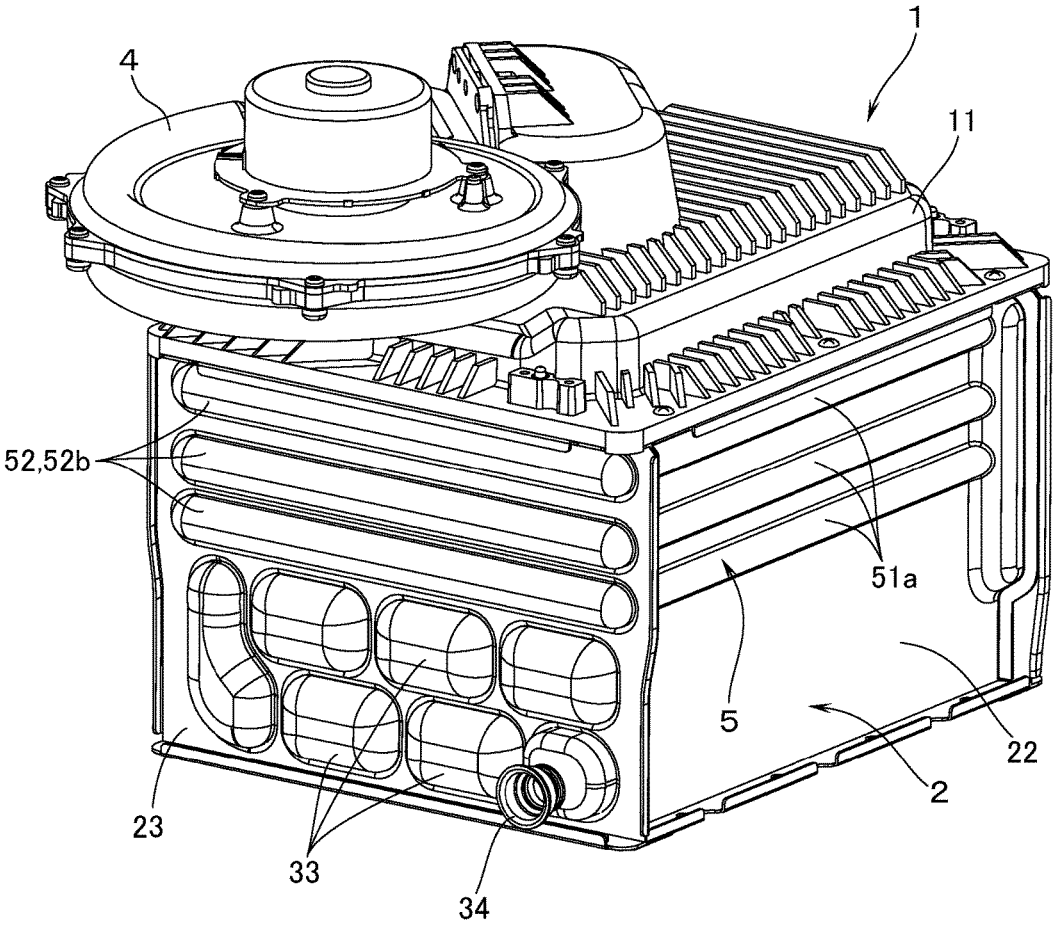
FIG. 2 is a perspective view of the heat source apparatus of the first embodiment as viewed from a side opposite to that in FIG. 1.
Figure 3:
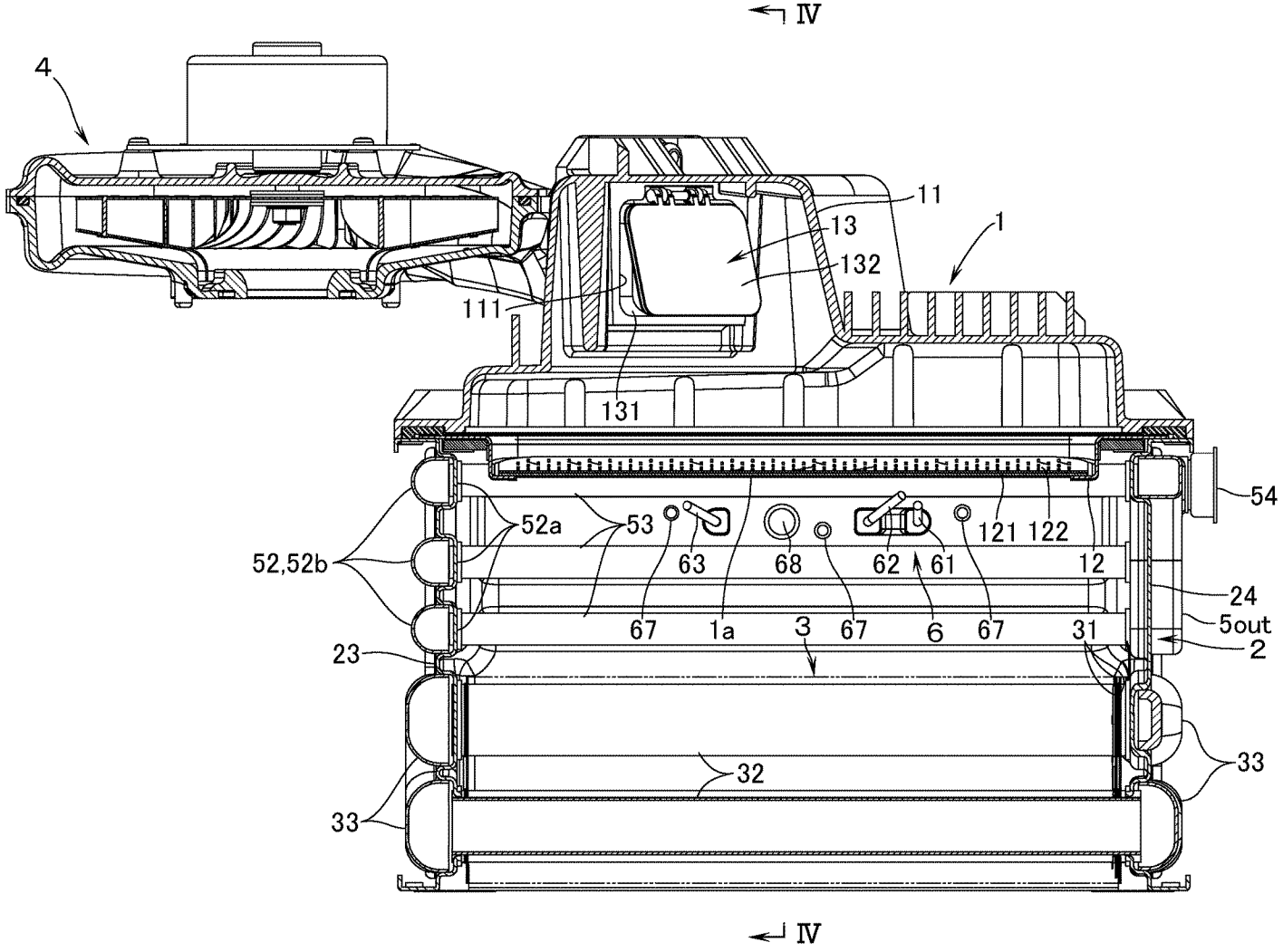
FIG. 3 is a sectional view partly cut away along the line III-III in FIG. 1.
Figure 4:
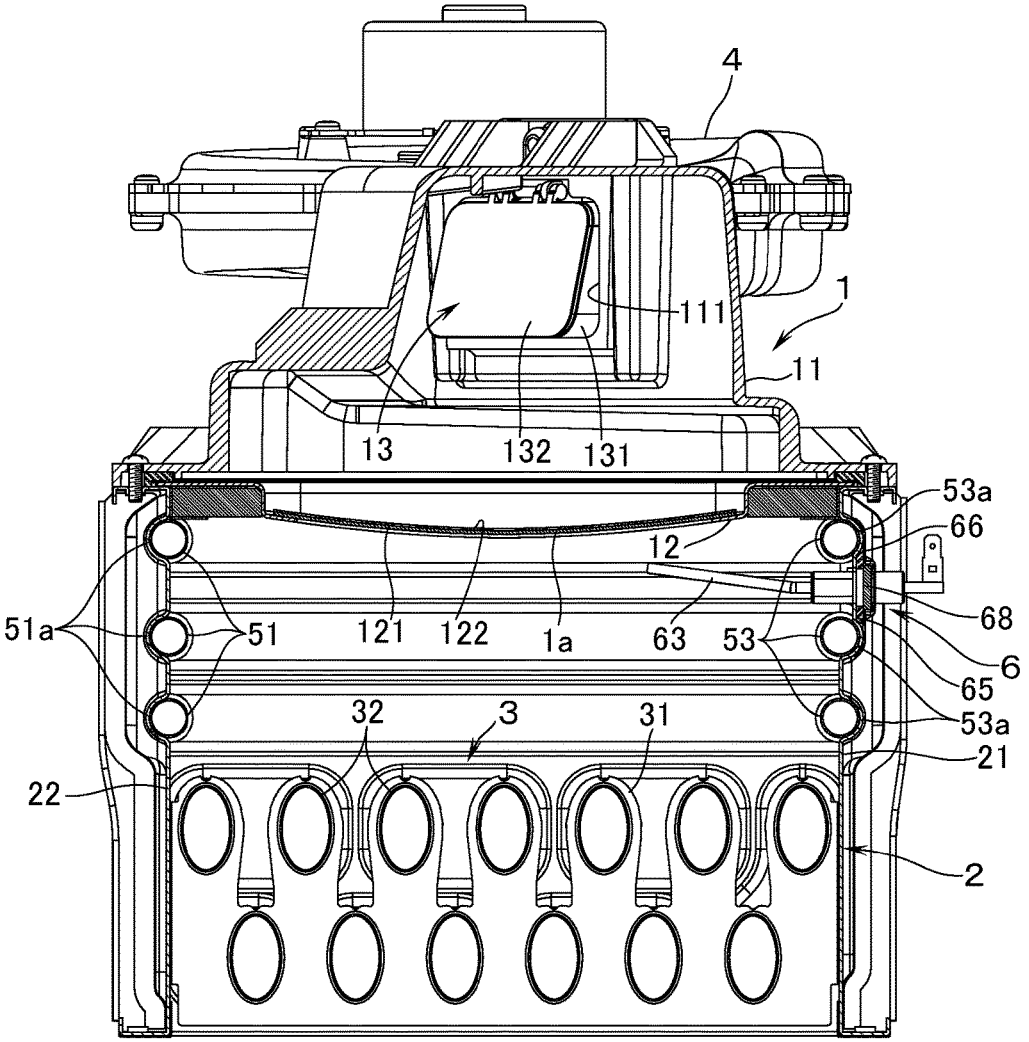
FIG. 4 is a sectional view partly cut away along the line IV-IV in FIG. 3.

With reference to FIGS. 1 through 4, a heat source apparatus according to the first embodiment of this invention is provided with: a burner 1 of a downward posture with a combustion surface la facing downward; and a combustion box 2 on a lower side of the burner 1, the combustion box 2 enclosing the combustion space for the air-fuel mixture that is ejected from the combustion surface 1*a*. The combustion box 2 is constituted by: a side plate 21 on the front side; a side plate 22 on the rear side; a side plate 23 on laterally one side; and a side plate 24 on laterally the other (opposite) side. In the lower portion of the combustion box 2 there is housed a heat exchanger 3 which heats the cold water for supplying hot water or for heating.

The burner 1 is constituted by: a burner body 11 whose lower surface is arranged to be an open surface; and a combustion plate 12 which is mounted on the lower surface of the burner body 11 and which constitutes the combustion surface 1*a*. The burner body 11 is provided with an inlet port 111 which is connected to a fan 4 for supplying air-fuel mixture. The inlet port 111 has a check valve 13 which is mounted to prevent the air-fuel mixture remaining inside the burner body 11 from flowing back toward the fan 4 at the time of stopping the fan 4. The check valve 13 is constituted by: a valve box 131 which is fit into the inlet port 111; and a valve plate 132 which is swingably mounted, for opening or closing, on that opening portion of the valve box which is directed toward the burner body 11. Further, the combustion plate 12 has a large opening portion in the central part of the combustion plate 12. This opening portion is covered by a piece of canvass 121 of heat-resistant fibers, and a distribution plate 122 with a multiplicity of distribution holes formed therein is overlapped on an upper surface of the canvass 121. It is thus so arranged that the air-fuel mixture inside the burner body 11 can be ejected through the distribution plate 122 and the canvass 121 for totally primary air combustion.

The heat exchanger 3 is constituted by a fin-tube type of heat exchanger having: a multiplicity of fins 31; and a plurality of heat-absorbing tubes 32 passing through these fins 31. On outside surfaces of laterally one side and laterally the other side of the side plates 23, 24 of the combustion box 2, there are mounted a plurality of connection lids 33 which define, between each of the side plates 23, 24 and the connection lids 33, connection passages for the adjoining two heat-absorbing tubes 32, 32. All of the heat-absorbing tubes 32 are thus connected in series to each other. In addition, in the connection lid 33 which defines, between the side plate 23 on one lateral side and the connection lid 33, the connection passage to be connected to the heat-absorbing tube 32 on the upstream end, there is provided a water inlet 34.

In addition, in that portion of the combustion box 2 which lies between the burner 1 and the heat exchanger 3, there is provided a water jacket 5 which is connected to the downstream side of the heat exchanger 3 in order to cool the combustion box 2. This water jacket 5 is constituted by: first water tubes 51 vertically arranged three pieces disposed on the side plate 22 on the rear side of the combustion box 2 so as to be laterally elongated; third water tubes 53 vertically arranged three pieces disposed on the side plate 21 on the front of the combustion box 2 so as to be laterally elongated; the second water tubes 52 vertically arranged three pieces so as to be elongated longitudinally (back and forth) so as to connect the first water tubes 51 and the third water tubes 53; an inlet-side header 5in which is disposed near the back of the laterally other side plate 24 of the combustion box 2 so as to introduce the water passed through the heat exchanger 3 into the first water tubes 51; and an outlet-side header 5out into which flows the water from the third water tubes 53. On an upper part of the outlet-side header 5out, there is provided a hot water outlet 54 for connecting the hot water supply passage. According to this arrangement, the water (hot water) passing through the heat exchanger 3 flows from the inlet-side header 5in through the first water tubes 51, the second water tubes 52, and the third water tubes 53 into the outlet-side header 5out, and is supplied from the hot water outlet port 54 to the hot water supply passage.

Each of the first and third water tubes 51, 53 is disposed on the inside surface of each of the side plates 21, 22 on the front side and on the rear side, respectively, of the combustion box 2. In concrete, on each of the side plates 21, 22 on the front side and the rear side, respectively, a swelled-out portion 51*a*, 53*a* swollen outward in a hemispherical shape is formed in a position in which each of the water tubes 51, 53 is disposed. Each of the water tubes 51, 53 is disposed into the respective swelled-out portions 51*a*, 53*a* in a state in which each of the water tubes 51, 53 is placed in position into the respective positions. In addition, the second water tube 52 is constituted by: an indented portion 52*a* which is formed in the side plate 23 in a manner to be dented laterally inward; and a cover 52*b* which covers the dented portion 52*a*.

Figure 5:
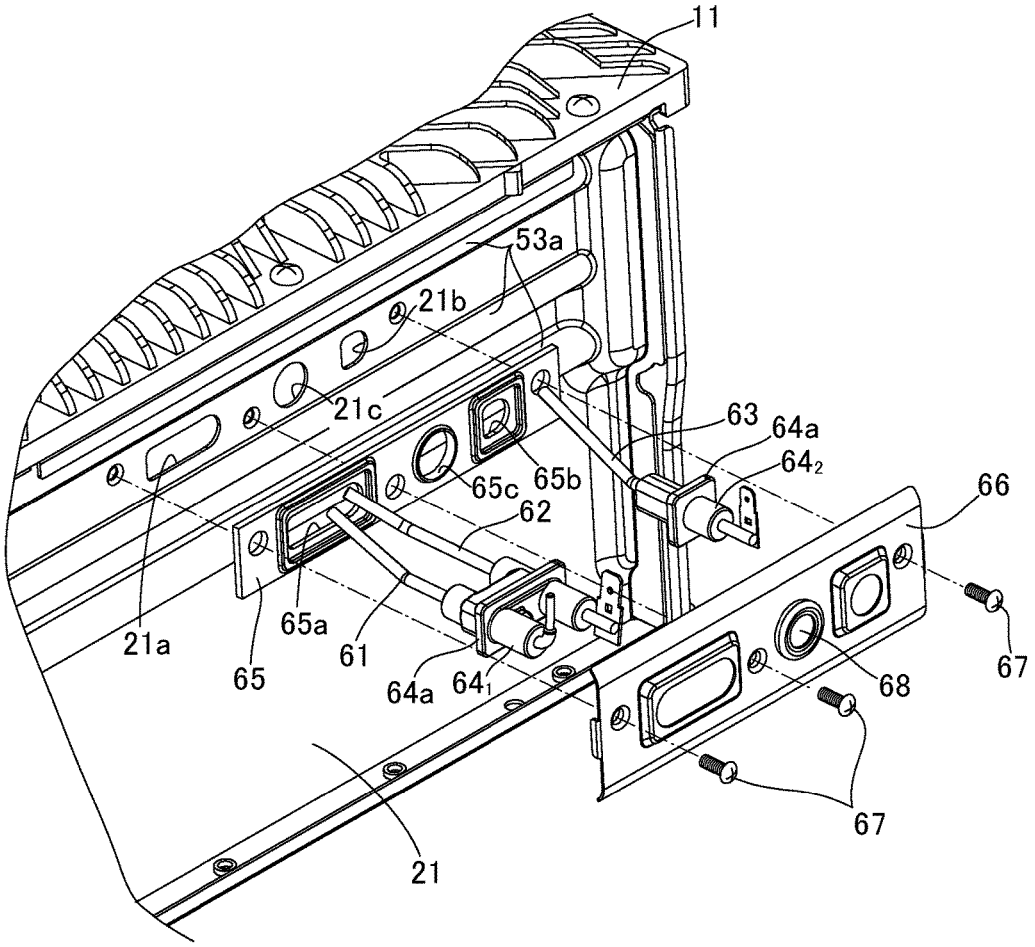
FIG. 5 is an exploded perspective view of an essential portion of the heat source apparatus of the first embodiment.

With reference also to FIG. 5, in that portion of the side plate 21 on the front side of the combustion box 2 which lies between the burner 1 and the heat exchanger 3, there is mounted an electrode component 6 made up of: an electrode including an ignition electrode 61, a ground electrode 62, and a flame rod 63; a first insulator $\mathbf{64}_1$ which fixes in position by inserting the ignition electrode 61 and the ground electrode 62; and a second insulator $\mathbf{64}_2$ which fixes in position by inserting the flame rod 63. The ignition electrode 61 and the ground electrode 62 protrude into the combustion box 2 through a laterally elongated through-hole 21*a* formed in the side plate 21. The flame rod 63 protrudes into the combustion box 2 through another through-hole 21*b* formed in the side plate 21. Each of the first and second insulators $\mathbf{64}_1$, $\mathbf{64}_2$ has a flanged portion 64*a* which overlaps with the surrounding portion of each of the through-holes

21*a,* 21*b* in the side plate 21. Then, in a state in which a common laterally elongated packing 65 is interposed between both the first and second flanged portions 64*a,* 64*a* of both the first and second insulators $\mathbf{64}_1$, $\mathbf{64}_2$ and the side plate 21, a common laterally elongated clamp 66 which overlaps with the outside surfaces of the flanged portions 64*a,* 64*a* of the insulators $\mathbf{64}_1$, $\mathbf{64}_2$ are fastened, i.e., fixed with screws 67, to the side plate 21, thereby mounting the electrode component 6 to the side plate 21.

The packing 65 has formed therein a through-hole 65*a* for inserting the ignition electrode 61 and the ground electrode 62, and also a through-hole 65*b* for inserting the flame rod 63. The clamp 66 is further provided with a peep hole (inspection hole) 68 for visually confirming the inside of the combustion box 2. The side plate 21 and the packing 65 have formed therein through-holes 21*c,* 65*c* corresponding to the peep hole 68.

By the way, it is for the purpose of preventing the combustion gas in the combustion box 2 from leaking out of the holes 21*a,* 21*b* to the outside that the packing 65 is used. It is to be noted here that, when the packing 65 is compressed by fastening the clamp 66, the packing may expand toward the surrounding direction. Then, the compression stress inside the packing 65 cannot be enhanced large enough, and the sealing property may sometimes become poor.

Figure 6:
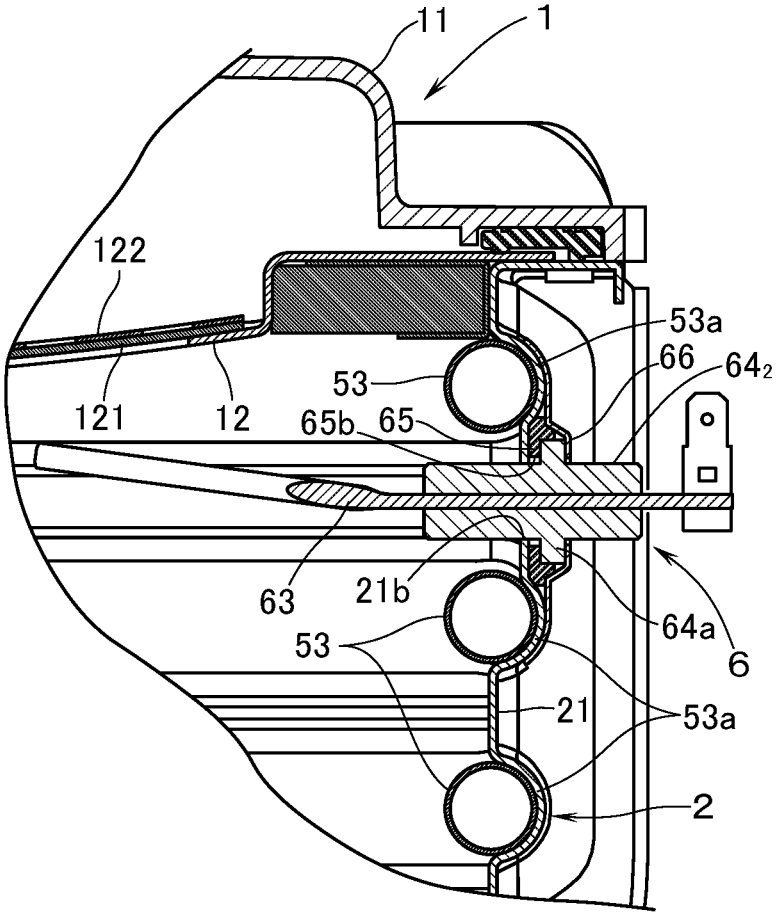
FIG. 6 is an enlarged sectional view of an essential portion of the heat source apparatus of the first embodiment.

As a solution, according to this embodiment, as shown in FIG. 6, the following arrangement has been made. In other words, the side plate 21 on the front side of the combustion box 2 has formed therein an upper swelled-out portion 53*a* and a lower swelled-out portion 53*a* for receiving therein the upper third water tube 53 and the lower third water tube 53, respectively, that are positioned on the upper side and the lower side of the portion in which the electrode component 6 is mounted. The upper and lower side edge portions of the packing 65 are arranged to come into contact with the upper and lower swelled-out portions 53*a,* 53*a*. According to this arrangement, when the packing 65 is compressed as a result of fastening of the clamp 66, the packing 65 can be prevented from expanding in the upward and downward directions. Therefore, the internal compression stress can be made sufficiently high, thereby obtaining good sealing properties.

Figure 7:
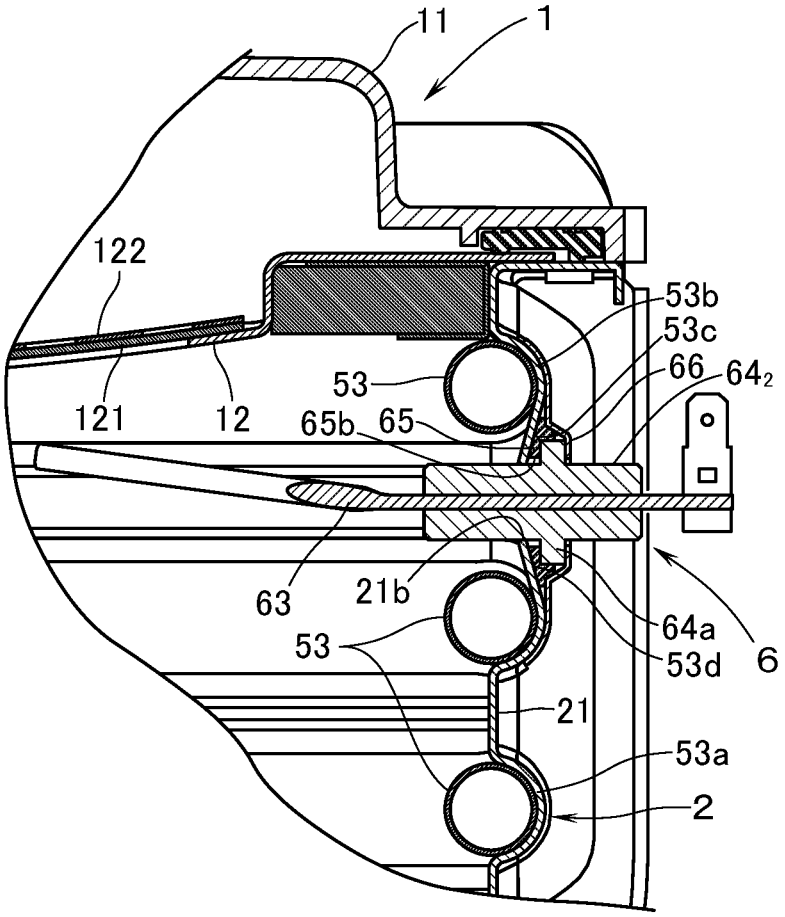
FIG. 7 is an enlarged sectional view of an essential portion of the heat source apparatus of the second embodiment.

Now, a description will be made of a second embodiment as shown in FIG. 7. In this second embodiment, the side plate 21 on the front side of the combustion box 2 has formed therein swelled-out portions 53*b* which are swollen outward and into which the upper and lower third water tubes 53, 53 are fit in position together. In an upper half of the swelled-out portion 53*b,* there is formed an inclined portion 53*c* that is inclined from the most outwardly swelled-out upper portion inward toward the lower part. In the lower half of the swelled-out portion 53*b,* there is formed an inclined portion 53*d* that is inclined from the most outwardly swelled-out lower portion inward toward the upper part. Further, the swelled-out portion 53*b* has formed, in a position between the inclined portion 53*c* in the upper half and the inclined portion 53*c* in the lower half, through-holes for inserting the electrodes, i.e., a through-hole 21*b* for inserting the flame rod as shown in FIG. 7, and through-holes 21*a* for inserting the ignition electrode 61 and the ground electrode 62, that are not illustrated in FIG. 7.

Then, in the second embodiment, it is so arranged that the upper part and lower part of the packing 65 respectively come into contact with the inclined portions 53*c,* 53*d* of the upper half and the lower half of the respective swelled-out portions 53*b*. According to this arrangement, when the packing 65 is compressed by fastening the clamp 66, the upper part of the packing 65 will be subjected to a downward force, and the lower part of the packing 65 will be subjected to an upward force respectively due to a component of force in the vertical direction of the compression reaction force from the inclined portions 53*c,* 53*d*. In this manner, the packing 65 can be prevented from expanding in the upward and downward directions. As a result, the compression force inside the packing 65 can be made sufficiently high, thereby securing good sealing properties.

Descriptions have so far been made of the embodiments of this invention with reference to the drawings. This invention shall, however, not be limited to the above. For example, in the above-mentioned first embodiment, the third water tube 53 is disposed on the inside surface of the side plate 21 on the front side of the combustion box 2. It is to be noted that the third water tube 53 may also be disposed on the outside surface of the side plate 21. In this case, the upper and lower side edge portions of the packing 65 may be brought into contact with the upper and lower water tubes 53 so that the packing 65 can be prevented from expanding in the upward and downward directions. In addition, the side plate on which the electric component 6 is mounted may alternatively be the side plate 22 on the rear side, or on one or the other of the side plate 23, 24 on the laterally one side or the other side. Further, the water jacket 5 may alternatively be connected to the upstream side of the heat exchanger 3.

EXPLANATION OF MARKS

1 burner
1*a* combustion surface
2 combustion box
21 side plate on the front side (side plate on one side, also referred to as "one-side side plate")
21*a,* 21*b* through-hole
3 heat exchanger
5 water jacket
53 third water tubes (upper and lower water tubes)
53*a* swelled-out portion
53*b* swelled-out portions into which upper and lower water tubes are fit in position together
53*c* inclined portion in upper half portion
53*d* inclined portion in lower half portion
6 electrode component
61 ignition electrode (electrode)
62 ground electrode (electrode)
63 flame rod (electrode)
$\mathbf{64}_1$, $\mathbf{64}_2$ insulator
64*a* flange portion
65 packing
66 clamp (retainer)

What is claimed is:

1. A heat source apparatus comprising:

a burner;

a combustion box for enclosing a combustion space for air-fuel mixture ejected from a combustion surface of the burner;

a heat exchanger, disposed in the combustion box, for heating cold water;

a water jacket disposed in that portion of the combustion box which lies between the burner and the heat exchanger, the water jacket being connected to the heat exchanger in order to cool the combustion box;

an electrode component mounted in that portion of a one-side side plate of the combustion box which lies between the burner and the heat exchanger, the electrode component comprising: an electrode which protrudes into the combustion box through a through-hole formed in the one-side side plate; and an insulator through which the electrode is fixedly inserted, the insulator having a flange portion which overlaps with a portion of outside surface around the through-hole in the one-side side plate and, in a state in which a packing is interposed between the flange portion and the one-side side plate, a clamp which overlaps with an outside surface of the flange portion is fastened to the one-side side plate, whereby the electrode component is mounted in position on the one-side side plate, wherein upper and lower water tubes constituting a part of the water jacket are disposed on the one-side side plate on upper and lower sides, respectively, of the position of mounting the electrode component;

wherein, in case the upper and lower water tubes are disposed on an inside surface of the one-side side plate, upper and lower side edge portions of the packing are in contact with those upper and lower swelled-out portions formed in the one-side side plate which are swollen outward for respectively receiving, into the swelled-out portions, the upper and lower water tubes; and wherein, in case the upper and lower water tubes are disposed on an outside surface of the one-side side plate, the upper and lower side edge portions of the packing are in contact with the upper and lower water tubes.

2. A heat source apparatus comprising:

a burner;

a combustion box for enclosing a combustion space for air-fuel mixture ejected from a combustion surface of the burner;

a heat exchanger, disposed in the combustion box, for heating cold water;

a water jacket disposed in that portion of the combustion box which lies between the burner and the heat exchanger, the water jacket being connected to the heat exchanger in order to cool the combustion box;

an electrode component mounted in that portion of a one-side side plate of the combustion box which lies between the burner and the heat exchanger, the electrode component comprising: an electrode which protrudes into the combustion box through a through-hole formed in the one-side side plate; and an insulator through which the electrode is fixedly inserted, the insulator having a flange portion which overlaps with a portion of outside surface around the through-hole in the one-side side plate and, in a state in which a packing is interposed between the flange portion and the one-side side plate, a clamp which overlaps with an outside surface of the flange portion is fastened to the one-side side plate, whereby the electrode component is mounted in position on the one-side side plate, wherein that upper and lower water tubes constituting a part of the water jacket are disposed on an inside surface of the one-side side plate on upper and lower sides, respectively, of the position of mounting the electrode component;

wherein the one-side side plate has swelled-out portions formed to swell outward such that the upper and lower water tubes are together fitted into the swelled-out portions;

wherein an upper half of the swelled-out portions is formed to have an inclined portion inclined inward from a most swelled-out upper portion downward; wherein a lower half of the swelled-out portions is formed to have an inclined portion inclined inward from a most swelled-out lower portion upward; wherein the through-hole for inserting the electrode is formed in a position between the inclined portion of the upper half and the inclined portion of the lower half such that an upper portion and a lower portion of the packing are, respectively, in contact with the inclined portions of the upper half and the lower half.

* * * * *